US010510290B2

(12) United States Patent
Song et al.

(10) Patent No.: US 10,510,290 B2
(45) Date of Patent: Dec. 17, 2019

(54) IMAGE PROCESSING METHOD AND APPARATUS FOR PREVENTING SCREEN BURN-INS AND RELATED DISPLAY APPARATUS

(71) Applicant: BOE TECHNOLOGY GROUP CO., LTD, Beijing (CN)

(72) Inventors: Danna Song, Beijing (CN); Zhongyuan Wu, Beijing (CN); Song Meng, Beijing (CN); Cuili Gai, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/038,362

(22) PCT Filed: Dec. 10, 2015

(86) PCT No.: PCT/CN2015/096898
§ 371 (c)(1),
(2) Date: May 20, 2016

(87) PCT Pub. No.: WO2016/169275
PCT Pub. Date: Oct. 27, 2016

(65) Prior Publication Data

US 2017/0116915 A1 Apr. 27, 2017

(30) Foreign Application Priority Data

Apr. 20, 2015 (CN) ..... 2015-10187770

(51) Int. Cl.
*G09G 3/3225* (2016.01)

(52) U.S. Cl.
CPC ... *G09G 3/3225* (2013.01); *G09G 2320/0271* (2013.01); *G09G 2320/046* (2013.01);
(Continued)

(58) Field of Classification Search
CPC ..... G09G 3/3225; G09G 2320/0271; G09G 2320/046; G09G 2320/0613; G09G 2320/0686; G09G 2360/16
See application file for complete search history.

(56) References Cited

U.S. PATENT DOCUMENTS 7,375,770 B2 5/2008 Chang
9,547,909 B2 * 1/2017 Du ..... G06K 9/4604
(Continued)

FOREIGN PATENT DOCUMENTS

CN 102930831 A 2/2013
CN 104282251 A 1/2015
(Continued)

OTHER PUBLICATIONS

The World Intellectual Property Organization (WIPO) International Search Report for PCT/CN2015/096898 dated Mar. 15, 2015 p. 1-5.
(Continued)

*Primary Examiner* — Patrick N Edouard
*Assistant Examiner* — Eboni N Giles
(74) *Attorney, Agent, or Firm* — Anova Law Group, PLLC

(57) ABSTRACT

The present invention provides a display apparatus with display screen burn-ins prevention functions, comprising a calculation module configured to identify a set of to-be-adjusted grayscale edge pixels corresponding to a static display part in a detection area based on a plurality of sets of grayscale edge pixels identified from a plurality of images in the detection area at different time instances; a determination module configured to determine whether the set of to-be-adjusted grayscale edge pixels is an empty set; and an adjustment module configured to adjust intensity levels of the to-be-adjusted grayscale edge pixels when the determi-
(Continued)

nation module determines that the set of to-be-adjusted grayscale edge pixels is not an empty set.

18 Claims, 3 Drawing Sheets

(52) U.S. Cl.
CPC ..... *G09G 2320/0613* (2013.01); *G09G 2320/0686* (2013.01); *G09G 2360/16* (2013.01)

(56) References Cited

U.S. PATENT DOCUMENTS

2002/0190940 A1* 12/2002 Itoh ..... G09G 3/3648 345/87
2005/0063603 A1 3/2005 Wang et al.
2005/0195280 A1 9/2005 Murakami et al.
2007/0217701 A1* 9/2007 Liu ..... G06K 9/38 382/234
2008/0106649 A1* 5/2008 Prusia ..... G09G 5/003 348/701
2008/0284702 A1 11/2008 Shidara et al.
2009/0060330 A1* 3/2009 Liu ..... G06K 9/342 382/173
2009/0175537 A1* 7/2009 Tribelhorn ..... G06K 9/00463 382/173
2009/0324122 A1* 12/2009 Kao ..... G06T 5/003 382/260
2011/0052061 A1* 3/2011 Jeong ..... G06K 9/00711 382/173
2011/0148906 A1* 6/2011 Jeong ..... G09G 3/2007 345/589
2013/0169663 A1* 7/2013 Seong ..... G09G 5/00 345/589
2014/0160142 A1 6/2014 Lee et al.
2015/0371594 A1* 12/2015 Huang ..... G09G 3/003 345/690
2016/0246430 A1* 8/2016 Wang ..... G06F 3/0416
2017/0047047 A1 2/2017 Zhao
2017/0116915 A1 4/2017 Song et al.

FOREIGN PATENT DOCUMENTS

CN 104766561 A 7/2015
JP H1013854 A 1/1998
JP 2005284266 A 10/2005
KR 1020110021195 A 3/2011
KR 20140075061 A 6/2014

OTHER PUBLICATIONS

Notification of the First Office Action of Korean application No. 10-2016-7033140 dated Jun. 8, 2018 14 Pages.
Korean Intellectual Property Office (KIPO) Office Action 2 for 20167033140 dated Dec. 27, 2018 14 Pages.
The European Patent Office (EPO) The Extended European Search Report for 15858103.3 dated Oct. 17, 2018 10 Pages.

* cited by examiner

IMAGE PROCESSING METHOD AND APPARATUS FOR PREVENTING SCREEN BURN-INS AND RELATED DISPLAY APPARATUS

CROSS-REFERENCES TO RELATED APPLICATIONS

This application is a national phase entry under 35 U.S.C. 071 of International Application No. PCT/CN2015/096898, filed on Dec. 10, 2015, which claims priority to Chinese Patent Application No. 201510187770.6, entitled "Method and Apparatus for Preventing Screen Burn-ins' filed on Apr. 20, 2015. The above enumerated patent applications are incorporated by reference herein in their entirety.

FIELD OF THE DISCLOSURE

The present disclosure relates to the field of display technologies and, more particularly, relates to a display method and apparatus for preventing screen burn-ins.

BACKGROUND

Active Matrix Organic Light Emitting Diode (AMOLED) has been widely adopted in various applications. Organic light-emitting diodes (OLED) are often used as the light-emitting pixel units in AMOLED display devices. In an AMOLED display device, driving thin film transistors (TFTs) are often operated in saturation region so that the driving TFTs may generate driving currents. The driving current may power the OLEDs to emit light.

However, driving currents may cause the TFTs and OLEDs to age. Higher driving currents often cause the OLEDs and the TFTs to age faster. When used in display devices, aged TFTs and OLEDs may appear as screen burn-ins. Further, as the display device ages, the screen burn-ins may become more apparent and severe.

Screen burn-ins often occur when a static image is displayed at a high intensity level (i.e., high gray scale) for a long time on a display panel. Dynamic images on the display panel may change contents all the time. The driving current of the TFTs and OLEDs relating to dynamic images may change according to content variations. Therefore, the aging of the TFTs and OLEDs relating to the dynamic image displays may be balanced over time.

However, contents of static images on the display panel usually remain unchanged over a period of time. Further, when a static image has high intensity levels, the driving currents of the TFTs and OLEDs relating to the static image stay at high levels. Therefore, on a display panel, TFTs and OLEDs relating to static images may age faster than TFTs and OLEDs relating to dynamic images.

Existing technologies often change the size of a static image in a very small scale, or move a static image towards various directions of slight distances. Thus, the static image may become a dynamic image to prevent screen burn-ins. However, in practice, to prevent noticeable changes in the display to users, the static image may not be shifted or resized at a significantly. A major portion of the static image may still remain at high intensity levels, thus causing screen burn-ins on the display panel.

BRIEF SUMMARY OF THE DISCLOSURE

One aspect of the present disclosure provides an image processing apparatus with display screen burn-ins prevention functions, including a calculation module, a determination module, and an adjustment module. The calculation module is configured to identify a set of to-be-adjusted grayscale edge pixels corresponding to a static display part in a detection area based on a plurality of sets of grayscale edge pixels identified from a plurality of images in the detection area at different time instances. The determination module is configured to determine whether the set of to-be-adjusted grayscale edge pixels is an empty set. The adjustment module is configured to adjust intensity levels of the to-be-adjusted grayscale edge pixels when the determination module determines that the set of to-be-adjusted grayscale edge pixels is not an empty set.

Further, the set of to-be-adjusted grayscale edge pixels may be obtained by calculating an intersection among the identified sets of grayscale edge pixels. The plurality of images in the detection area may be obtained at predefined time intervals.

The acquisition module may be further configured to respectively identify the plurality of sets of grayscale edge pixels from the plurality of images shown at different time instances. When the adjustment module finishes adjusting intensity levels of the to-be-adjusted grayscale edge pixels, the adjustment module may be further configured to start the acquisition module to identify a next set of to-be-adjusted grayscale edge pixels from images incorporating the adjusted grayscale edge pixels.

The acquisition module may be further includes an edge function value calculation submodule configured to calculate edge function values of pixels of an image using a preconfigured edge detection operator; an edge function value threshold query submodule configured to search for a corresponding edge function value threshold of each pixel in a preconfigured threshold value table based on environmental intensity level of the pixel; and a comparison submodule configured to compare the edge function value of each pixel with the corresponding edge function value threshold, wherein when the edge function value of the pixel is greater than the corresponding edge function value threshold, the pixel is determined to be a grayscale edge pixel.

Further, the image processing apparatus may further include a control module. The control module is configured to stop the display apparatus from adjusting intensity levels of pixels in the detection area when the determination module determines that the set of to-be-adjusted grayscale edge pixels is empty.

The set of to-be-adjusted grayscale edge pixels may be identified based on a first set of grayscale edge pixels detected from an image shown in the detection area at a first time instance and a second set of grayscale edge pixels is identified from an image shown in the detection area at a second time instance. The set of to-be-adjusted grayscale edge pixels may be obtained by calculating an intersection between the first set of grayscale edge pixels and the second set of grayscale edge pixels.

The adjustment module may be further configured to adjust an intensity level of a currently processed pixel to an average intensity level of all neighboring pixels of the currently processed pixel.

The adjustment module may be further configured to adjust an intensity level of a currently processed pixel to a value smaller than an average intensity level of all neighboring pixels of the currently processed pixel.

The adjustment module may be further configured to adjust an intensity level of a currently processed pixel to a value smaller than an intensity level of any one of neighboring pixels of the currently processed pixel.

Another aspect of the present disclosure provides an image processing method. The method may include identifying a set of to-be-adjusted grayscale edge pixels corresponding to a static display part in a detection area of a display screen based on a plurality of sets of grayscale edge pixels identified from a plurality of images in the detection area at different time instances. The method further includes determining whether the set of to-be-adjusted grayscale edge pixels is an empty set. When the set of to-be-adjusted grayscale edge pixels is not an empty set, adjusting intensity levels of the to-be-adjusted grayscale edge pixels. The method further includes returning to the step of identifying a set of to-be-adjusted grayscale edge pixels when the step of adjusting the intensity levels of the to-be-adjusted grayscale edge pixels is finished.

Further, the set of to-be-adjusted grayscale edge pixels may be obtained by calculating an intersection among the identified sets of grayscale edge pixels. The plurality of images in the detection area may be obtained at predefined time intervals.

The method may further include respectively detecting the plurality of sets of grayscale edge pixels from the plurality of images shown at different time instances. When the step of adjusting intensity levels of the to-be-adjusted grayscale edge pixels is finished, a next set of to-be-adjusted grayscale edge pixels from a plurality of images incorporating the adjusted grayscale edge pixels may be identified.

The step of respectively detecting the plurality of sets of grayscale edge pixels may further include: calculating edge function values of pixels of an image using a preconfigured edge detection operator, searching for a corresponding edge function value threshold of each pixel in a preconfigured threshold value table based on an environmental intensity level of the pixel; and comparing the edge function value of each pixel with the corresponding edge function value threshold. When the edge function value of the pixel is greater than the corresponding edge function value threshold, the pixel may be determined to be a grayscale edge pixel.

The image processing method may further include stopping adjusting intensity levels of pixels in the detection area, when the set of to-be-adjusted grayscale edge pixels is an empty set.

The set of to-be-adjusted grayscale edge pixels may be identified based on a first set of grayscale edge pixels detected from an image shown in the detection area at a first time instance and a second set of grayscale edge pixels is identified from an image shown in the detection area at a second time instance. The set of to-be-adjusted grayscale edge pixels may be obtained by calculating an intersection between the first set of grayscale edge pixels and the second set of grayscale edge pixels.

The step of adjusting intensity levels of the to-be-adjusted grayscale edge pixels may further include adjusting an intensity level of a currently processed pixel to an average intensity level of all neighboring pixels of the currently processed pixel.

The step of adjusting intensity levels of the to-be-adjusted grayscale edge pixels may further include an intensity level of a currently processed pixel to a value smaller than an average intensity level of all neighboring pixels of the currently processed pixel.

The step of adjusting intensity levels of the to-be-adjusted grayscale edge pixels may further include an intensity level of a currently processed pixel to a value smaller than an intensity level of any one of neighboring pixels of the currently processed pixel.

The image processing method may further include monitoring accumulated displaying durations for a plurality of channels. When an accumulated displaying duration of a currently-displaying channel exceeds a preset threshold, the step of identifying a set of to-be-adjusted grayscale edge pixels may be initiated.

Another aspect of the present disclosure provides an image display apparatus incorporating one or more display apparatus described above.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the invention, which are illustrated in the accompanying drawings. Hereinafter, embodiments according to the disclosure will be described with reference to the drawings. Wherever possible, the same reference numbers will be used throughout the drawings to refer to the same or like parts. It is apparent that the described embodiments are some but not all of the embodiments of the present invention. Based on the disclosed embodiments, persons of ordinary skill in the art may derive other embodiments according to the present disclosure, all of which are within the scope of the present invention.

Figure 1:
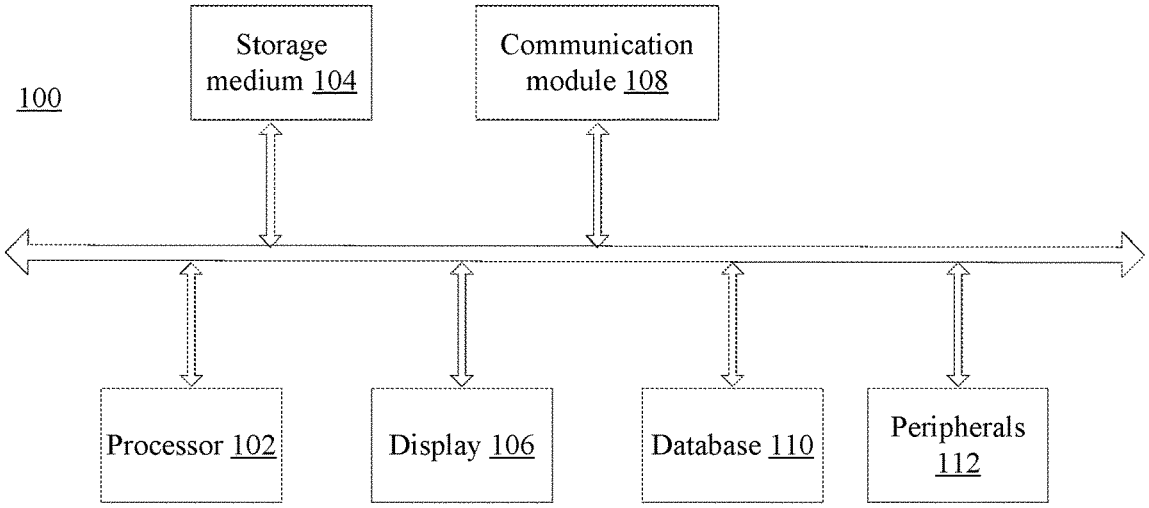
FIG. 1 illustrates an exemplary computing system according to various embodiments of the present disclosure.

The present disclosure provides a display method and apparatus for preventing screen burn-ins. The display method and apparatus may be used in any appropriate display devices. The display devices may be implemented on any appropriate computing circuitry platform. FIG. 1 illustrates a block diagram of an exemplary computing system according to various embodiments of the present disclosure.

Computing system 100 may include any appropriate type of TV, such as a plasma TV, a liquid crystal display (LCD) TV, a touch screen TV, a projection TV, a non-smart TV, a smart TV, etc. Computing system 100 may also include other computing systems, such as a personal computer (PC), a tablet or mobile computer, or a smart phone, etc. In addition, computing system 100 may be any appropriate content-presentation device capable of presenting multiple programs in one or more channels. Users may interact with computing system 100 watch various programs and perform other activities of interest.

As shown in FIG. 1, computing system 100 may include a processor 102, a storage medium 104, a display 106, a communication module 108, a database 110 and peripherals 112. Certain devices may be omitted and other devices may be included to better describe the relevant embodiments.

Processor 102 may include any appropriate processor or processors. Further, processor 102 can include multiple cores for multi-thread or parallel processing. Processor 102 may execute sequences of computer program instructions to perform various processes. Storage medium 104 may include memory modules, such as ROM, RAM, flash memory modules, and mass storages, such as CD-ROM and hard disk, etc. Storage medium 104 may store computer programs for implementing various processes when the computer programs are executed by processor 102, such as computer programs for implementing an image processing algorithm.

Further, communication module 108 may include certain network interface devices for establishing connections through communication networks, such as TV cable network, wireless network, internet, etc. Database 110 may include one or more databases for storing certain data and for performing certain operations on the stored data, such as database searching.

Display 106 may provide information to users, such as displaying TV programs and video streams. Display 106 may include any appropriate type of computer display device or electronic device display such as LCD or OLED based devices. Peripherals 112 may include various sensors and other I/O devices, such as keyboard and mouse.

In operation, the computing system 100, may receive a video stream for further processing. The video stream may be from a TV program content provider, locally stored video data, video data received from other sources over the network, or video data inputted from other peripherals 112, etc. The processor 102 may perform certain image processing techniques to adjust displaying images. For example, the computing system 100 may adjust gray levels of certain pixels in an image from the video stream and send to display 106 for presentation.

Figure 2:
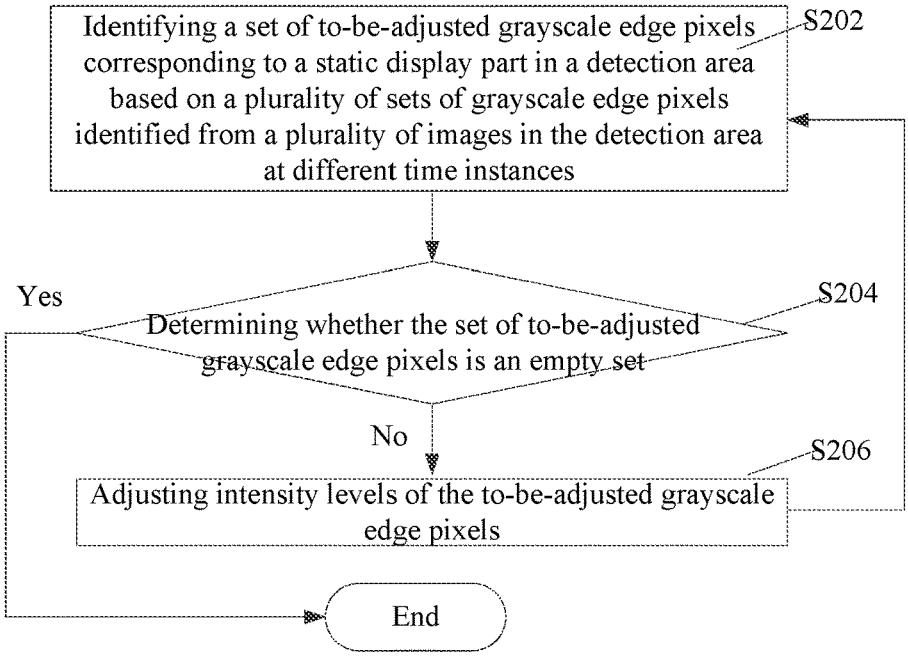
FIG. 2 illustrates a flow chart of an exemplary method for preventing screen burn-ins according to various embodiments of the present disclosure.

FIG. 2 illustrates a flow chart of an exemplary image processing method for preventing screen burn-ins according to various embodiments of the present disclosure. As shown in FIG. 2, the method may include the following steps. The method may be implemented by, for example, a display device incorporating the computing system 100. The display device may include a display panel.

In a detection area on the display screen, different images may be shown at different times. In some embodiments, the detection area may display a first image at a first time instance, and display a second image at a second time instance. Based on a first set of grayscale edge pixels associated with the first image and a second set of grayscale edge pixels associated with the second image, a set of grayscale edge pixels corresponding to a static display part in the detection area that need to be adjusted may be identified (S202).

It should be noted that, the detection area, as used in the present disclosure, may refer to any predefined area on the display panel. The detection area may be prone to screen burn-ins. In one example, the predefined area may be the upper right corner or the upper left corner of the display panel where logos of TV channels are often displayed. In another example, the predefined area may be the lower right corner or the lower left corner of the display panel where additional information or program guides are often presented.

The detection area may be divided into two parts: a static display part and a dynamic display part. Contents shown in the static display part, such as a TV channel logo, may be unchanged over a period of time. Contents shown in the dynamic display part may be changing, such as the images in a TV program. The grayscale edge, as used herein, may refer to locations in an image where the grayscale of pixels change sharply or have discontinuities. The grayscale edge is often constituted of a plurality of pixels that have high intensity levels or outstanding intensity levels among neighboring pixels. The intensity level, as used herein, may refer to the gray level or brightness level of a pixel.

Further, any appropriate existing edge detection technologies may be applied in the present disclosure to identify grayscale edge pixels from images shown in the detection area. Detailed edge detection methods are not elaborated herein.

When the grayscale edge pixels of an image shown in the detection area are identified, some edge pixels may belong to the static display part, and some edge pixels may belong to the dynamic display part. Further, contents in the dynamic display part may vary over time. Thus, the edge pixels corresponding to the dynamic display part may also change over time. Meanwhile, contents in the static display part may be unchanged over a period of time. Thus, the edge pixels corresponding to the static display part may remain unchanged over a period of time.

In step S202, an intersection between the first set of grayscale edge pixels and the second set of grayscale edge pixels may be determined. The intersection may contain edge pixels corresponding to the static display part (i.e., the set of to-be-adjusted grayscale edge pixels). Therefore, pixels in the static display part that have high intensity levels may be identified.

It should be noted that the set of to-be-adjusted grayscale edge pixels corresponding to a static display part may be determined based on more than two sets of grayscale edge pixels from two or more images at different times. Further, the images may be obtained at a predefine time interval (e.g., 5 second). For example, three images may be obtained at three time instances (e.g., 1 second, 6 second, and 11 second). Three sets of grayscale edge pixels of the three images may be detected. Further, an intersection among the three sets grayscale edge pixels may be calculated and identified as the set of to-be-adjusted grayscale edge pixels.

Step S204 may include determining whether the set of to-be-adjusted grayscale edge pixels is an empty set. That is, step S204 may include determining whether the intersection between the detected sets of grayscale edge pixels is an empty set.

When the intersection of the detected sets of grayscale edge pixels is not an empty set, the static display part may contain pixels that have high intensity levels and step S206 may be performed. When the intersection of the detected sets of grayscale edge pixels is an empty set, the static display part may not contain pixels that have high intensity levels. The process may end.

Step S206 may include adjusting intensity levels of the to-be-adjusted grayscale edge pixels. The intensity levels of the to-be-adjusted grayscale edge pixels may be adjusted to have lower intensity levels. When finishing adjusting the to-be-adjusted grayscale edge pixels, the process may return to step S202.

In step S206, when adjusting the intensity levels of the to-be-adjusted grayscale edge pixels, the intensity levels of the grayscale edge pixels corresponding to the static display part may be changed. Then the process may return to step S202, a new set of to-be-adjusted grayscale edge pixels may be identified and adjusted. Such process may be repeated until the system (e.g., computing system 100) determines that the intersection of the detected sets of grayscale edge pixels is an empty set. That is, the static display part of the detection area does not contain pixels with high intensity levels. Thus, the current adjusting process may be completed.

It should be noted that, in the process of adjusting intensity levels of the to-be-adjusted grayscale edge pixels (i.e., looping steps S202, S204 and S206), the positions of the to-be-adjusted grayscale edge pixels may move from the peripheral toward the center of the static display part through each loop. Further, when the set of to-be-adjusted grayscale edge pixels becomes an empty set, the looping process may be completed.

In various embodiments, step S206 may implement various algorithms to adjust the intensity level of a to-be-adjusted grayscale edge pixel. The to-be-adjusted grayscale edge pixel currently being processed may be referred to as a current pixel. The intensity level of the current pixel may be adjusted based on its neighboring pixels. For example, the neighboring pixels may be 8 pixels surrounding the current pixel in a 3*3 matrix, or 24 pixels surrounding the current pixel in a 5*5 matrix.

In a first embodiment, the intensity level of the current pixel may be adjusted to an average intensity level of all neighboring pixels. In a second embodiment, the intensity level of the current pixel may be adjusted to a value smaller than the average intensity level of all neighboring pixels. In a third embodiment, the intensity level of the current pixel may be adjusted to a value smaller than the intensity levels of any one of the neighboring pixels.

Further, the neighboring pixels of the current pixel may contain grayscale edge pixels and non-edge pixels. In a fourth embodiment, the intensity level of the current pixel may be adjusted to a value equal to the intensity level of one neighboring non-edge pixel. In a fifth embodiment, the intensity level of the current pixel may be adjusted to an average intensity level of three neighboring non-edge pixels. In a sixth embodiment, the intensity level of the current pixel may be adjusted to an average intensity level of all neighboring non-edge pixels.

The disclosed six embodiments even out the intensity levels based on the current pixel and its neighboring pixels. Thus, the adjustment of the intensity level of the current pixel may be in a small scale and not be noticeable to users. That is, the user experience may not be affected.

It should be noted that the disclosed six embodiments are exemplary techniques when implementing step S206, and do not limit the scope of the present disclosure. In addition to the embodiments described above, other appropriate smoothing techniques may also be applied in the present disclosure.

Figure 3:
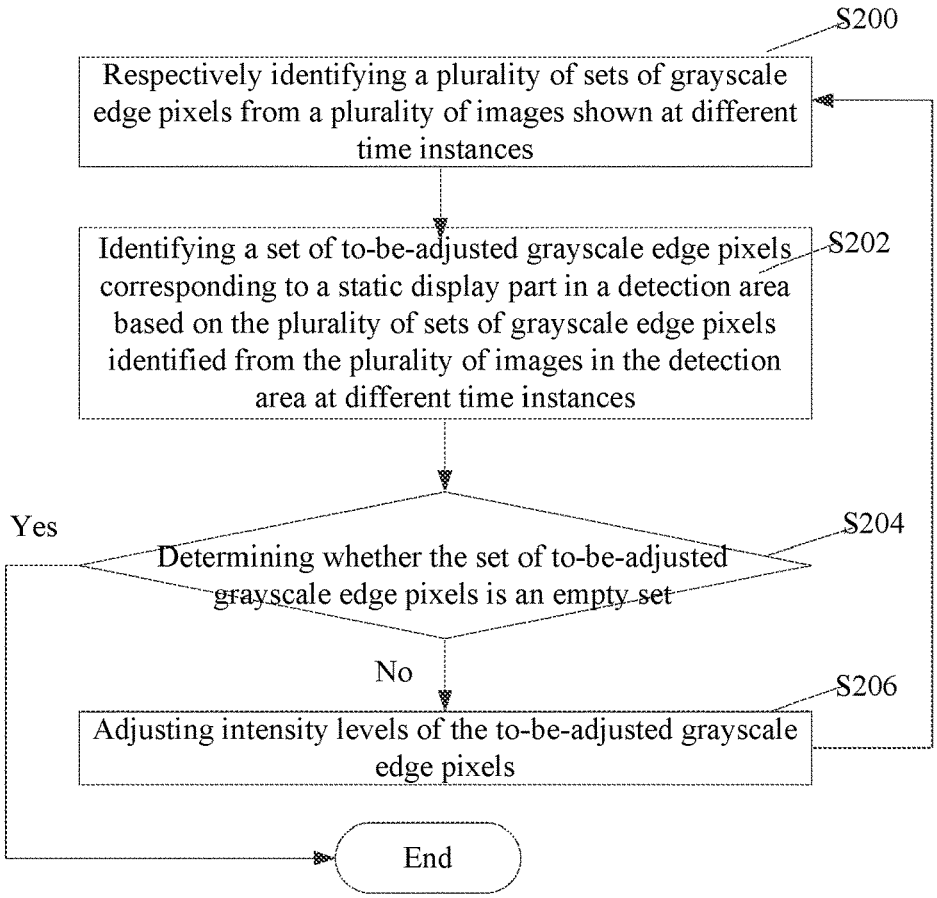
FIG. 3 illustrates a flow chart of another exemplary method for preventing screen burn-ins according to various embodiments of the present disclosure.

FIG. 3 illustrates a flow chart of another exemplary method for preventing screen burn-ins according to various embodiments of the present disclosure. As shown in FIG. 3 and in comparison with FIG. 2, the method may further include a step S200 before step S202.

The detection area may display a plurality of images at different times. For example, a first image may be shown at a first time instance, and a second image may be shown at a second time instance. Step S200 may include respectively obtaining a plurality of sets of grayscale edge pixels from a plurality of images shown at different times. For example, a first set of grayscale edge pixels may be obtained from the first image, and a second set of grayscale edge pixels may be obtained from the second image.

Figure 4:
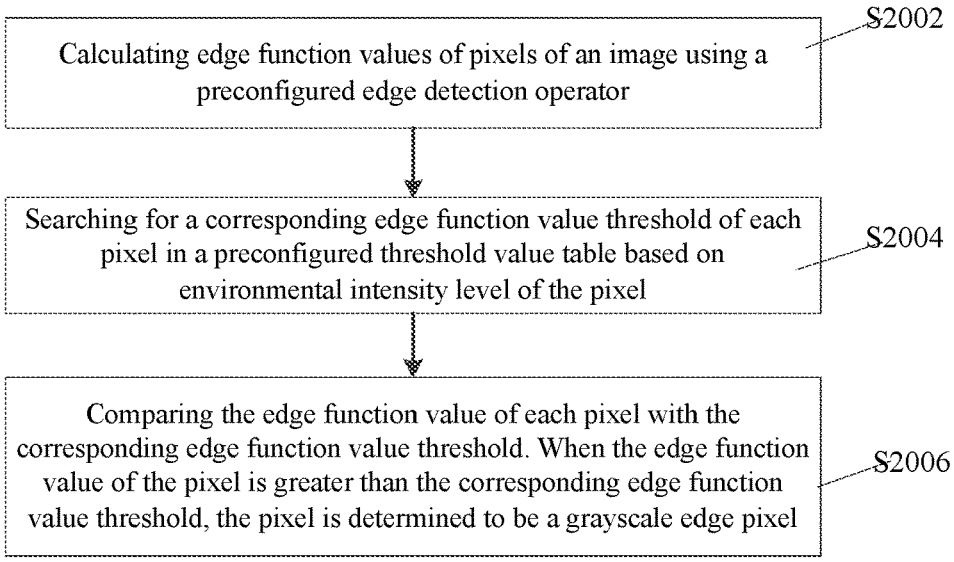
FIG. 4 illustrates a flow chart of an exemplary process for calculating grayscale edge pixels according to various embodiments of the present disclosure.

In some embodiments, step S200 may further include the following steps to calculate a set of grayscale edge pixels corresponding to an image. As shown in FIG. 4, step S2002 may include calculating edge function values of pixels in the detection area using a preconfigured edge detection operator. Further, the edge detection operator may be a differential edge detection operator.

For example, the preconfigured edge detection operator may be denoted as expression (1).

$$\begin{pmatrix} -1, -1, -1 \\ -1, 8, -1 \\ -1, -1, -1 \end{pmatrix} \tag{1}$$

Further, the intensity level of a pixel at location (m,n) may be denoted as f(m,n). The edge function value of a pixel at location (m,n) may be denoted as G(m,n). The edge function value of a pixel may be calculated using equation (2).

$$G(m,n)=8*f(m,n)-f(m-1,n-1)-f(m,n-1)-f(m+1,n-1)-f(m-1,n)-$$

$$f(m+1,n)-f(m-1,n+1)-f(m,n+1)-f(m+1,n+1) \tag{2}$$

It should be noted that other proper edge detection operator may be applied in the present disclosure, such as the Roberts Cross operator, Prewitt operator, Sobel operator, etc. Detailed calculation process is not repeated here.

Further, based on environmental intensity level of each pixel (e.g., intensity levels of its neighboring pixels), step S2004 may include searching for a corresponding edge function value threshold of the pixel in a preconfigured threshold value table.

In some embodiments, the environmental intensity level of a pixel may be determined based on pixels in a predefined range centering the current pixel (e.g., its neighboring pixels). In one example, the environmental intensity level of a pixel may be the average intensity level of all neighboring pixels. In another example, frequencies of intensity levels in the neighboring pixels may be collected. The intensity level having the highest frequency may be considered as the environmental intensity level.

The preconfigured threshold value table may contain different edge function value thresholds corresponding to different environmental intensity levels. The data in the preconfigured threshold value table may be collected from previous experiments. In some embodiments, in the preconfigured threshold value table, higher environmental intensity levels may correspond to lower edge function value thresholds.

Step S2006 may include comparing the edge function value of each pixel with its corresponding edge function value threshold. When the edge function value of a pixel is greater than its corresponding threshold, the pixel is determined to be a grayscale edge pixel.

That is, by comparing the edge function value G(m,n) obtained from step S2002 with the threshold value obtained from step S2004, it may be determined whether a pixel belongs to the grayscale edge. When the edge function value of a pixel is greater than or equal to its corresponding threshold value, the pixel is determined to be a grayscale edge pixel. When the edge function value of a pixel is less than its corresponding threshold, the pixel is not a grayscale edge pixel.

In some embodiments, when step S200 includes obtaining two sets of grayscale edge pixels from the first image and the second image, step S2002 to step S2006 may be performed twice. It should be noted that steps S2002, S2004 and S2006 are exemplary techniques when implementing step S200, and do not limit the scope of the present disclosure.

Further, returning to FIG. 3, when the adjustment process in step S206 is finished, the system may return to perform step S200, until the set of to-be-adjusted edge pixels is determined to be an empty set in step S204.

In some embodiments, the image processing method may further include monitoring accumulated displaying durations for a plurality of channels, and initiating the process of identifying and adjusting pixel intensities when the displaying duration of a currently-displaying channel exceeds a preset threshold (e.g., initiating step S202 or step S200). For example, when the display apparatus is turned on, a user may switch between different TV channels. Each displayed TV channel may associate with a timer to record its accumulated displaying time. When the accumulated displaying time for a currently-displaying channel exceeds a preset threshold (e.g., 30 minutes), the system may proceed to perform the image processing method for preventing screen burn-ins. That is, when the user watched one channel for a long time, temporarily switches to another channel, and then switch back to the original channel, the system may still determine to initiate the adjusting process based on the accumulated displaying time.

Various embodiments according to the present disclosure provide a method to prevent screen burn-ins, which may smoothly adjust intensity levels of static contents in the detection area on a display panel.

Figure 5:
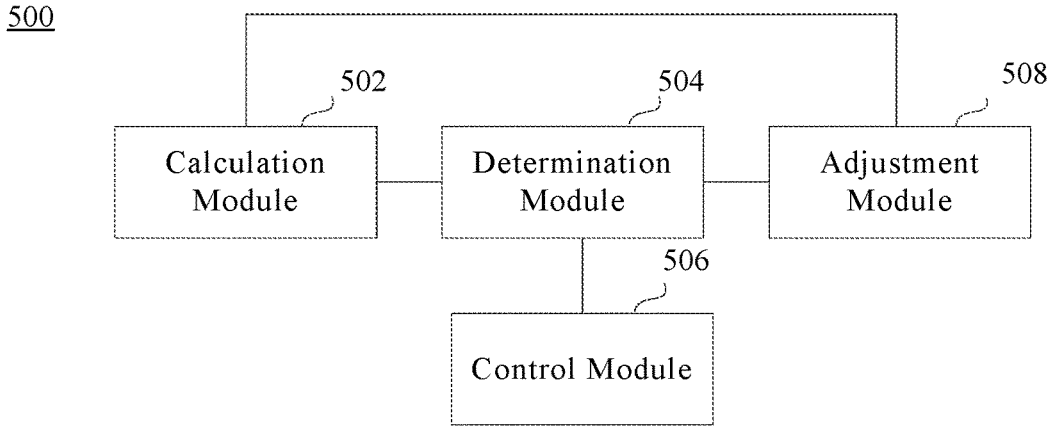
FIG. 5 illustrates a structure diagram of an exemplary apparatus for preventing screen burn-ins according to various embodiments of the present disclosure.

FIG. 5 illustrates a structure diagram of an exemplary apparatus for preventing screen burn-ins according to various embodiments of the present disclosure. As shown in FIG. 5, the exemplary apparatus 500 may include a calculation module 502, a determination module 504, a control module 506 and an adjustment module 508. The calculation module 502 may connect to the determination module 504. The determination module may connect to the control module 506 and the adjustment module 508. Further, the adjustment module 508 may connect to the calculation module 502.

The calculation module 502 may be configured to identify a set of to-be-adjusted grayscale edge pixels corresponding to a static display part in a detection area based on a plurality of sets of grayscale edge pixels detected from a plurality of images in the detection area at different times. The set of to-be-adjusted grayscale edge pixels may be obtained by calculating an intersection among the detected sets of grayscale edge pixels.

In one embodiment, the calculation module 502 may detect two sets of grayscale edge pixels from two images at two different time instances. Further, the calculation module 502 may calculate an intersection between the two sets of grayscale edge pixels to obtain the set of to-be-adjusted grayscale edge pixels.

The determination module 504 may be configured to determine whether the set of to-be-adjusted grayscale edge pixels is empty, and to notify the control module 506 and the adjustment module 508. When the determination module 504 determines that the set of to-be-adjusted grayscale edge pixels is empty, the control module 506 may be configured to stop the apparatus 500 from adjusting intensity levels.

When the determination module 504 determines that the set of to-be-adjusted grayscale edge pixels is not empty, the adjustment module 508 may be configured to adjust intensity level of each pixel in the set of to-be-adjusted grayscale edge pixels. When the adjustment module 508 finishes adjusting the set of to-be-adjusted grayscale edge pixels, the adjustment module 508 may be configured to notify the calculation module 502 to start another loop of calculation.

In operation, the calculation module 502 may perform the procedures described in step S202. The determination module 504 and the control module 506 may perform the procedures described in step S204. The adjustment module 508 may perform the procedures described in step S206.

In various embodiments, the adjustment module 508 may implement various algorithms to adjust the intensity level of a to-be-adjusted grayscale edge pixel. The to-be-adjusted grayscale edge pixel currently being processed may be referred to as a current pixel. The intensity level of the current pixel may be adjusted based on its neighboring pixels.

In a first embodiment, the adjustment module 508 may include a first adjustment submodule configured to adjust the intensity level of the current pixel to an average intensity level of all neighboring pixels. In a second embodiment, the adjustment module 508 may include a second adjustment submodule configured to adjust the intensity level of the current pixel to a value smaller than the average intensity level of all neighboring pixels. In a third embodiment, the adjustment module 508 may include a third adjustment submodule configured to adjust the intensity level of the current pixel to a value smaller than the intensity levels of any one of the neighboring pixels.

Further, the neighboring pixels of the current pixel may contain grayscale edge pixels and non-edge pixels. In a fourth embodiment, the adjustment module 508 may include a fourth adjustment submodule configured to adjust the intensity level of the current pixel to a value equal to the intensity level of one neighboring non-edge pixel. In a fifth embodiment, the adjustment module 508 may include a fifth adjustment submodule configured to adjust the intensity level of the current pixel to an average intensity level of three neighboring non-edge pixels. In a sixth embodiment, the adjustment module 508 may include a sixth adjustment submodule configured to adjust the intensity level of the current pixel to an average intensity level of all neighboring non-edge pixels.

The disclosed six embodiments adjust the intensity levels based on the current pixel and its neighboring pixels. Thus, the adjustment of the intensity level of the current pixel may be in a small scale and not be noticeable to users. That is, the user experience may not be affected.

Figure 6:
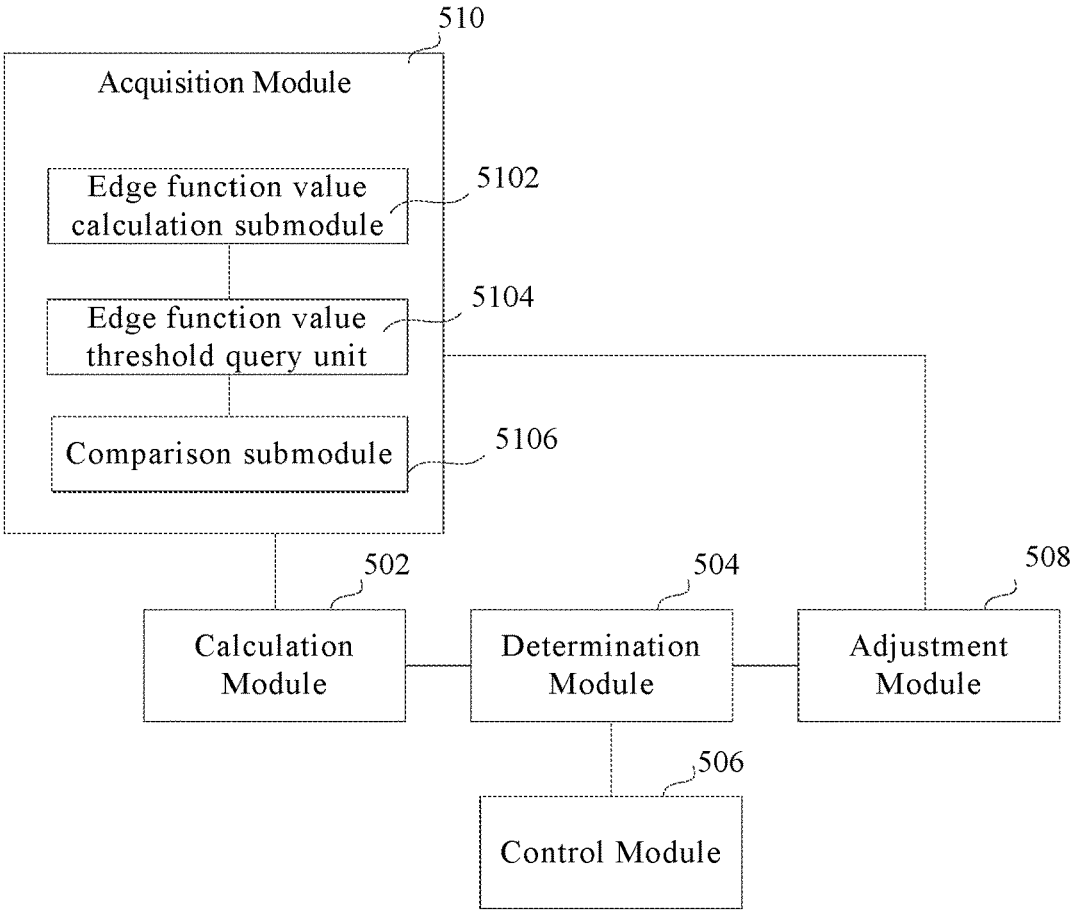
FIG. 6 illustrates a structure diagram of another exemplary apparatus for preventing screen burn-ins according to various embodiments of the present disclosure.

FIG. 6 illustrates a structure diagram of an exemplary apparatus for preventing screen burn-ins according to various embodiments of the present disclosure. As shown in FIG. 6, and in comparison with FIG. 5, the apparatus 500 may further include an acquisition module 510.

The acquisition module 510 may connect to the calculation module 502. The acquisition module 510 may be configured to respectively obtain a plurality of sets of grayscale edge pixels from a plurality of images shown at different times. Further, the acquisition module 510 may connect to the adjustment module 508. When the adjustment module 508 finishes adjusting intensity levels of the to-be-adjusted pixels, the adjustment module 508 may notify the acquisition module 510 to initiate a next calculation loop based on the adjusted images.

In some embodiments, the acquisition module 510 may further include an edge function value calculation submodule 5102, an edge function value threshold query submodule 5104 and a comparison submodule 5106.

The edge function value calculation submodule 5102 may be configured to calculate edge function values of pixels in the detection area using a preconfigured edge detection operator. Further, the edge detection operator may be a differential edge detection operator.

The edge function value threshold query submodule 5104 may be configured to search for a corresponding edge function value threshold of each pixel in a preconfigured threshold value table based on environmental intensity levels of the pixels (e.g., intensity levels of its neighboring pixels).

In some embodiments, the environmental intensity level of a pixel may be determined based on pixels in a predefined range centering the current pixel (e.g., its neighboring pixels). In one example, the environmental intensity level of a pixel may be the average intensity level of all neighboring pixels. In another example, frequencies of intensity levels in the neighboring pixels may be collected. The intensity level having the highest frequency may be considered as the environmental intensity level.

The preconfigured threshold value table may contain different edge function value thresholds corresponding to different environmental intensity levels. The data in the preconfigured threshold value table may be collected from previous experiments. In some embodiments, in the preconfigured threshold value table, higher environmental intensity levels may correspond to lower edge function value threshold values.

The comparison submodule 5106 may be configured to compare the edge function value of each pixel with its corresponding edge function value threshold. When the edge function value of a pixel is greater than its corresponding threshold value, the pixel is determined to be a grayscale edge pixel.

In operation, the edge function value calculation submodule 5102 may perform procedures described in step S2002. The edge function value threshold query submodule 5104 may perform procedures described in step S2004. The comparison submodule 5106 may perform procedures described in step S2006.

Various embodiments according to the present disclosure provide a display apparatus for preventing screen burn-ins, which may smoothly adjust intensity levels of static contents in the detection area on a display panel.

During each adjustment process, intensity levels of a small number of pixels may be adjusted in each computation loop. Users may rarely notice these adjustments. By repeating the looping process, the intensity levels of all pixels relating to the static display part in the detection area may be evened out. Therefore, screen burn-ins may be prevented without compromising user experience.

In various embodiments, the disclosed modules for the exemplary system as depicted above can be configured in one device or configured in multiple devices as desired. The modules disclosed herein can be integrated in one module or in multiple modules for processing messages. Each of the modules disclosed herein can be divided into one or more sub-modules, which can be recombined in any manners.

The disclosed embodiments are examples only. One of ordinary skill in the art would appreciate that suitable software and/or hardware (e.g., a universal hardware platform) may be included and used to perform the disclosed methods. For example, the disclosed embodiments can be implemented by hardware only, which alternatively can be implemented by software only or a combination of hardware and software. The software can be stored in a storage medium. The software can include suitable commands to enable any client device (e.g., including a digital camera, a smart terminal, a server, or a network device, etc.) to implement the disclosed embodiments. For example, the disclosed method and system may be implemented on a computation chip, a circuit board, or a software program in a microcontroller. Further, the disclosed method and system may be implemented in a display apparatus that includes the computation chip, the circuit board, or the software program in a microcontroller.

Other embodiments of the disclosure will be apparent to those skilled in the art from consideration of the specification and practice of the invention disclosed herein. It is intended that the specification and examples be considered as exemplary only, with a true scope and spirit of the invention being indicated by the claims.

What is claimed is:

1. An image processing apparatus with display screen burn-ins prevention functions, comprising:

an acquisition module configured to:

calculate first edge function values of pixels of a first image taken at a first time instance;

determine a first environmental intensity level of each corresponding pixel in the first image by:

collecting frequencies of intensity level in neighboring pixels of each pixel of the first image and determining an intensity level having a highest frequency as the first environmental level, or determining an average intensity level of neighboring pixels of each pixel in the first image as the first environmental intensity level;

obtain a first edge function value threshold corresponding to each pixel of the first image based on the corresponding first environmental intensity level;

identify, by comparing the first edge function of each pixel of the first image with the corresponding first edge function value threshold, a first set of grayscale edge pixels from the first image in a detection area of a display screen according to the first edge function values, an edge function value of each pixel of the first set of grayscale edge pixels being greater than the corresponding first edge function value threshold, and the first set of grayscale edge pixels indicating locations in the first image where a difference between a grayscale of a pixel and a grayscale of a neighboring pixel in the first image is greater than a first threshold;

calculate second edge function values of pixels of a second image taken at a second time instance;

determine a second environmental intensity level of each corresponding pixel in the second image by:

collecting frequencies of intensity level in neighboring pixels of each pixel of the second image and determining an intensity level having a highest frequency as the second environmental level, or determining an average intensity level of neighboring pixels of each pixel in the second image as the second environmental intensity level;

obtain a second edge function value threshold corresponding to each pixel of the second image based on the corresponding environmental intensity level; and identify, by comparing the second edge function of each pixel of the second image with the corresponding second edge function value threshold, a second set of grayscale edge pixels from the second image in the detection area according to the second edge function values, an edge function value of each pixel of the second set of grayscale edge pixels being greater than the corresponding second edge function value threshold, and the second set of grayscale edge pixels indicating locations in the second image where a difference between a grayscale of a pixel and a grayscale of a neighboring pixel in the second image is greater than a second threshold;

a calculation module configured to:

calculate an intersection between the first set of grayscale edge pixels and the second set of grayscale edge pixels by corresponding the first and second sets of grayscale edge pixels of same locations to obtain the first and second sets of grayscale edge pixels having same intensity levels; and identify the intersection as a set of to-be-adjusted grayscale edge pixels corresponding to a static display part in the detection area of the display screen, each of the to-be-adjusted grayscale edge pixels corresponding to a first pixel in the first image and a second pixel in the second image, the first pixel and the second pixel having a same location and a same intensity level;

a determination module configured to determine whether the set of to-be-adjusted grayscale edge pixels is an empty set, the empty set indicating no pixel of the first and second images in the static display part contains high intensity levels; and an adjustment module configured to adjust intensity levels of the to-be-adjusted grayscale edge pixels in response to the determination module determining that the set of to-be-adjusted grayscale edge pixels is not an empty set.

2. The apparatus according to claim 1, wherein:

the first and second images in the detection area are obtained at predefined time intervals.

3. The apparatus according to claim 1, wherein upon the adjustment module finishing the step of adjusting the intensity levels of the to-be-adjusted grayscale edge pixels, the adjustment module is further configured to start the acquisition module to identify a next set of to-be-adjusted grayscale edge pixels from images incorporating the adjusted grayscale edge pixels.

4. The apparatus according to claim 3, wherein the acquisition module further comprises:

an edge function value calculation submodule configured to calculate the first and second edge function values of pixels of the first and second images, respectively, using a preconfigured edge detection operator.

5. The apparatus according to claim 1, further comprising:

a control module configured to stop the image processing apparatus from adjusting the intensity levels of the to-be-adjusted grayscale edge pixels in the detection area upon the determination module determining that the set of to-be-adjusted grayscale edge pixels is an empty set.

6. The apparatus according to claim 1, wherein the adjustment module is further configured to:

adjust an intensity level of a currently processed pixel to an average intensity level of all neighboring pixels of the currently processed pixel.

7. The apparatus according to claim 1, wherein the adjustment module is further configured to:

adjust an intensity level of a currently processed pixel to a value smaller than an average intensity level of all neighboring pixels of the currently processed pixel.

8. The apparatus according to claim 1, wherein the adjustment module is further configured to:

adjust an intensity level of a currently processed pixel to a value smaller than an intensity level of any one of neighboring pixels of the currently processed pixel.

9. A display apparatus incorporating one or more image processing apparatus according to claim 1.

10. An image processing method, comprising:

calculating first edge function values of pixels of a first image taken at a first time instance;

determining a first environmental intensity level of each corresponding pixel in the first image by:

collecting frequencies of intensity level in neighboring pixels of each pixel of the first image and determining an intensity level having a highest frequency as the first environmental level, or determining an average intensity level of neighboring pixels of each pixel in the first image as the first environmental intensity level;

obtaining a first edge function value threshold corresponding to each pixel of the first image based on the corresponding first environmental intensity level;

identifying, by comparing the first edge function of each pixel of the first image with the corresponding first edge function value threshold, a first set of grayscale edge pixels from the first image in a detection area of a display screen according to the first edge function values, an edge function value of each pixel of the first set of grayscale edge pixels being greater than the corresponding first edge function value threshold, and the first set of grayscale edge pixels indicating locations in the first image where a difference between a grayscale of a pixel and a grayscale of a neighboring pixel in the first image is greater than a first threshold;

calculating second edge function values of pixels of a second image taken at a second time instance;

determining a second environmental intensity level of each corresponding pixel in the second image by:

collecting frequencies of intensity level in neighboring pixels of each pixel of the second image and determining an intensity level having a highest frequency as the second environmental level, or determining an average intensity level of neighboring pixels of each pixel in the second image as the second environmental intensity level;

obtaining a second edge function value threshold corresponding to each pixel of the second image based on the corresponding environmental intensity level;

identifying, by comparing the second edge function of each pixel of the second image with the second corresponding edge function value threshold, a second set of grayscale edge pixels from the second image in the detection area according to the second edge function values, an edge function value of each pixel of the second set of grayscale edge pixels being greater than the second corresponding edge function value threshold, and the second set of grayscale edge pixels indicating locations in the second image where a difference between a grayscale of a pixel and a grayscale of a neighboring pixel in the second image is greater than a second threshold;

calculating an intersection between the first set of grayscale edge pixels and the second set of grayscale edge pixels by corresponding the first and second sets of grayscale edge pixels of same locations to obtain the first and second sets of grayscale edge pixels having same intensity levels;

identifying the intersection as a set of to-be-adjusted grayscale edge pixels corresponding to a static display part in the detection area of the display screen, each of the to-be-adjusted grayscale edge pixels corresponding to a first pixel in the first image and a second pixel in the second image, the first pixel and the second pixel having a same location and a same intensity levels;

determining whether the set of to-be-adjusted grayscale edge pixels is an empty set, the empty set indicating no pixel of the first and second images in the static display part contains high intensity levels;

in response to determining that the set of to-be-adjusted grayscale edge pixels is not an empty set, adjusting intensity levels of the to-be-adjusted grayscale edge pixels; and upon finishing the step of adjusting the intensity levels of the to-be-adjusted grayscale edge pixels, returning to the step of identifying a set of to-be-adjusted grayscale edge pixels.

11. The method according to claim 10, wherein:

the first and second images in the detection area are obtained at predefined time intervals.

12. The method according to claim 10, further comprising:

upon finishing the step of adjusting intensity levels of the to-be-adjusted grayscale edge pixels, identifying a next set of to-be-adjusted grayscale edge pixels from a plurality of images incorporating the adjusted grayscale edge pixels.

13. The method according to claim 10, wherein identifying the first and second sets of grayscale edge pixels, respectively, comprises:

calculating the first and second edge function values of pixels of the first image and the second image using a preconfigured edge detection operator, respectively.

14. The method according to claim 10, further comprising:

upon determining that the set of to-be-adjusted grayscale edge pixels is an empty set, stopping the step of adjusting the intensity levels of the to-be-adjusted grayscale edge pixels in the detection area.

15. The method according to claim 10, wherein adjusting the intensity levels of the to-be-adjusted grayscale edge pixels further comprises:

adjusting an intensity level of a currently processed pixel to an average intensity level of all neighboring pixels of the currently processed pixel.

16. The method according to claim 10, wherein adjusting the intensity levels of the to-be-adjusted grayscale edge pixels further comprises:

adjusting an intensity level of a currently processed pixel to a value smaller than an average intensity level of all neighboring pixels of the currently processed pixel.

17. The method according to claim 10, wherein adjusting the intensity levels of the to-be-adjusted grayscale edge pixels further comprises:

adjusting an intensity level of a currently processed pixel to a value smaller than intensity levels of any one of neighboring pixels of the currently processed pixel.

18. The method according to claim 10, further comprising:

monitoring accumulated displaying durations for a plurality of channels; and upon determining that an accumulated displaying duration of a currently-displaying channel exceeds a preset threshold, initiating the step of identifying a set of to-be-adjusted grayscale edge pixels.

* * * * *